US006732665B1

(12) United States Patent
Kuebel

(10) Patent No.: US 6,732,665 B1
(45) Date of Patent: May 11, 2004

(54) METHOD FOR GENERATING THERMAL ENERGY FROM FINE-GRAINED OILSEEDS, PREFERABLY FROM RAPESEED, AND DEVICE FOR CARRYING OUT THE METHOD

(76) Inventor: Johann Kuebel, Steinabruck 35, Kasten (AT), A-3072

( * ) Notice: Subject to any disclaimer, the term of this patent is extended or adjusted under 35 U.S.C. 154(b) by 0 days.

(21) Appl. No.: 10/089,396

(22) PCT Filed: Oct. 2, 2000

(86) PCT No.: PCT/AT00/00259

§ 371 (c)(1),
(2), (4) Date: Sep. 5, 2002

(87) PCT Pub. No.: WO01/25688

PCT Pub. Date: Apr. 12, 2001

(30) Foreign Application Priority Data

Oct. 1, 1999 (AT) ..... 1682/99

(51) Int. Cl.[7] ..... F23G 7/00
(52) U.S. Cl. ..... 110/346; 110/262
(58) Field of Search ..... 110/203, 207, 110/346, 196, 210, 211, 212, 213, 214, 262; 431/1, 157; 60/39.76, 39.77, 39.81

(56) References Cited

U.S. PATENT DOCUMENTS 2,861,423 A 11/1958 Jerie et al.
3,473,879 A * 10/1969 Berberich ..... 431/1
3,802,020 A * 4/1974 Stone et al. ..... 15/4
4,113,315 A * 9/1978 Melton et al. ..... 299/13
4,334,485 A * 6/1982 Guida ..... 110/347
5,249,952 A * 10/1993 West et al. ..... 431/5
5,343,819 A * 9/1994 Charest ..... 110/233

FOREIGN PATENT DOCUMENTS

DE 197 57 619 A1 7/1999
FR 1082410 12/1954

* cited by examiner

*Primary Examiner*—Kenneth B Rinehart
(74) *Attorney, Agent, or Firm*—Townsend and Townsend and Crew, LLP

(57) ABSTRACT

The invention relates to an arrangement for utilizing small-grained oilseeds, preferably rapeseed, without the need for prior processing of the seeds such as expressing the oil, in which a pressure of at least 2 bar is maintained in the combustion space (2) of a combustion chamber (1). In this combustion space, an oil or gas burner (8) is provided, which preheats the combustion space (2) to a temperature of at least c. 1000° C., causing the initial seeds fed into the combustion space (2) through a feed line (3) to ignite, if the required combustion air is supplied at the same time through a combustion air supply line (6). The seeds fed in subsequently through the feed line bum explosively in a chain reaction if the combustion air is supplied in controlled amounts, and if the required pressure is maintained in the combustion space. The resulting flame exits through a flame exit opening (9) and can be used for heating purposes.

27 Claims, 2 Drawing Sheets

METHOD FOR GENERATING THERMAL ENERGY FROM FINE-GRAINED OILSEEDS, PREFERABLY FROM RAPESEED, AND DEVICE FOR CARRYING OUT THE METHOD

BACKGROUND OF THE INVENTION

The invention relates to a method for producing thermal energy from small-grained oilseeds, preferably from rapeseed. The invention also relates to an arrangement for the implementation of such a method.

It is already known from prior art that rapeseed oil produced by pressing the seeds can be burned and that the resulting thermal energy can be utilized. However, such a production of rapeseed oil requires a separate operation, which means that such a method is cost-intensive. Furthermore, the hulls of the seeds, which remain after pressing, must be removed separately, for example by incinerating them in special burners.

An arrangement for producing thermal energy is known from U.S. Pat. No. 5,249,952, which shows combustion air supply lines which lead into several combustion chambers arranged in succession. One of these combustion chambers has a feed line for liquid and/or gaseous combustible substances and a feed line for solids, which can be admixed during the combustion process in this combustion chamber. To start the combustion process, it is provided with a sparkplug which can ignite an oil that is being supplied. With this known arrangement, it is not possible to bum the unreduced seeds of oil crops without an additional supply of liquid and/or gaseous fuels.

SUMMARY OF THE INVENTION

It is an object of the present invention to avoid the above-mentioned disadvantages and to create a method and an arrangement for producing thermal energy from small-grained oilseeds, preferably from rapeseed, with which the seeds can be burned without the need of prior processing. To achieve this objective, the invention proposes a method in which the combustion space of a combustion chamber is first preheated, and in which unreduced seeds and combustion air are supplied in controlled amounts, after which the preheating ends and a pressure of at least 2 bar is maintained in the combustion space, whereby the subsequently supplied oilseeds burn explosively, and the resulting flame exits through a flame exit opening.

It has been found that after the seeds fed in first have ignited due to the temperature in the preheated combustion space, the seeds fed in subsequently are burning explosively in a chain reaction if the combustion air is delivered in controlled amounts as needed, and if the required pressure is maintained in the combustion space. It is not necessary to process the seeds before they are fed into the combustion space, which means a considerable simplification of the method and a reduction in cost. It is sufficient only to ensure a continuously controlled supply of seeds into the combustion space, preferably individually in succession.

Preferably, the combustion space of a combustion chamber is preheated to a temperature between 500° C. and 1250° C., for example, to a temperature of c. 1000° C. This temperature ensures the ignition of the seeds fed into the combustion space first, and the preheating process can be ended after such ignition.

An uninterrupted chain reaction during the explosive combustion of the seeds is ensured if a pressure between 2 bar and 13 bar is maintained in the combustion chamber; the maximum values of pressure represent peak values which occur during the explosion of the seeds.

Preferably, the seeds of the oil crops fed in are forced to perform a spiral movement in at least one section of the combustion space, which prolongs their retention time in the combustion space and thus ensures the complete combustion of all the seeds fed in.

It is furthermore an advantage if the volume of the combustion space is variable, so that the pressure existing in the combustion space can be controlled as well and can be adapted to the requirements, especially in the starting phase during the preheating process.

An arrangement for implementing the method according to the invention is characterized substantially by a combustion chamber with a combustion space in which a disconnectible preheating device, such as an oil burner, is provided, leading into which are a feed line for feeding in the oilseeds and at least one combustion air supply line, and which is provided with a flame exit opening, whereby devices for maintaining a pressure in the combustion space are provided. In such an arrangement, the seeds are fed in controlled amounts through the feed line into the combustion space, where they are explosively burned after initial ignition due to the temperature following preheating, while the required amount of combustion air is present and while the required pressure is maintained, whereby the resulting flame exits from the flame exit opening and delivers its heat energy.

If the oilseeds are fed in through the feed line and the required combustion air is delivered through the combustion air supply line with positive pressure, a pressure drop can be prevented in the combustion space. However, to ensure that the arrangement according to the invention operates satisfactorily, it is advantageous when, according to a further embodiment of the invention, the required pressure in the combustion space is maintained by means of pressure control devices provided in the feed line for feeding in the seeds and/or in the area of the flame exit opening.

It is practical when a controllable proportioning device is provided in the feed line for feeding in the oilseeds, which not only adapts the amount of fed-in seeds to the combustion process, but can also be designed as a pressure control device.

In a preferred embodiment of the arrangement according to the invention, the combustion space consists of an interior tube and an exterior casing which surrounds the interior tube with clearance and communicates with the interior tube. This results in a design which, in spite of its compact size, ensures the required retention time of the oilseeds in the combustion space.

In such an embodiment, it is an advantage if the feed line for feeding in the seeds leads into the interior tube in which the disconnectible preheating device is arranged, and if the flame exit opening is provided in the exterior casing. In that case, the oilseeds are first fed through the feed line into the interior tube, which was heated by the preheating device to a temperature at which the initial ignition takes place. Subsequently, the preheating device can be disconnected, since the temperature required for igniting the individual seeds is maintained by the combustion process. The oilseeds fed into the interior tube pass through the interior tube into the exterior casing, which communicates with the interior tube, where afterburning occurs until finally the resulting flame exits through the flame exit opening. Due to the fact that the feed line leads into the interior tube and thus penetrates the space defined by the exterior casing where afterburning occurs, the seeds are already heated in the section of the feed line which penetrates the space before the seeds enter the interior tube, thus promoting the combustion process in the interior tube.

It has been found advantageous to provide the interior wall of the interior tube with a spiral recess, whereby the feed line preferentially leads tangentially into the interior tube. This design forces the oilseeds fed into the interior tube to perform a spiral movement, thus enlarging the path of the seeds inside the interior tube and prolonging their retention time in the interior tube.

As already mentioned, it is advantageous if the volume of the combustion space is variable. For that purpose, according to the invention, a wall of the exterior casing, preferably an end wall that extends perpendicular to the axis of the interior tube, can be of adjustable design. By adjusting the wall, the volume of the combustion space is enlarged when the arrangement according to the invention is started, and the pressure control devices in the area of the flame exit opening also are adjusted in such a way that the low pressure required in the combustion space during the starting process is ensured. After initial ignition has occurred, the volume of the combustion space is decreased, thus ensuring the pressure required for the explosive combustion of the oilseeds.

It is practical to design one wall of the exterior casing as a plate that is movable, preferably by means of an electrical actuator. According to the invention, at least one combustion air supply line leads into the interior tube, preferably tangentially, ensuring that the amount of combustion air required for the combustion of the oilseeds is available there. The tangential delivery of the combustion air promotes the spiral movement of the seeds in the interior tube.

To ensure complete afterburning in the space enclosed by the exterior casing, another combustion air supply line for delivering secondary air can lead into this space.

It is practical to provide a controllable blower in at least one combustion air supply line, which controls the amount of combustion air needed for the explosive combustion. This blower can be designed in such a way that it serves as a pressure controller device for maintaining the required pressure in the combustion space.

To provide pressure control in the area of the flame exit opening, the flame exit opening may, for example, be designed as a Venturi nozzle, whereby it is advantageous to design the flame exit opening as a multi-stage Venturi nozzle. In that case, an afterburner device can be provided between the individual stages, where the afterburning of the unburned gases can take place. Preferably, however, in the flame exit opening, which is preferably designed as a pipe end, at least one throttle is provided with which the pressure in the combustion space can be controlled by changing the flap position.

To maintain the pressure in the combustion space, the flame exit opening may also be designed as a labyrinth.

As already mentioned, considerably high temperatures occur in the combustion space. To prevent damage caused by these temperatures, it is advantageous to construct the combustion chamber with the combustion space, in particular the interior tube and the surrounding exterior casing, from a fire resistant, preferably ceramic, material. However, the combustion space may also be surrounded by a cooling jacket, which prevents overheating.

The arrangement according to the invention is described by means of examples of embodiments shown in schematic view in the following drawings.

DESCRIPTION OF THE PREFERRED EMBODIMENTS

Figure 1:
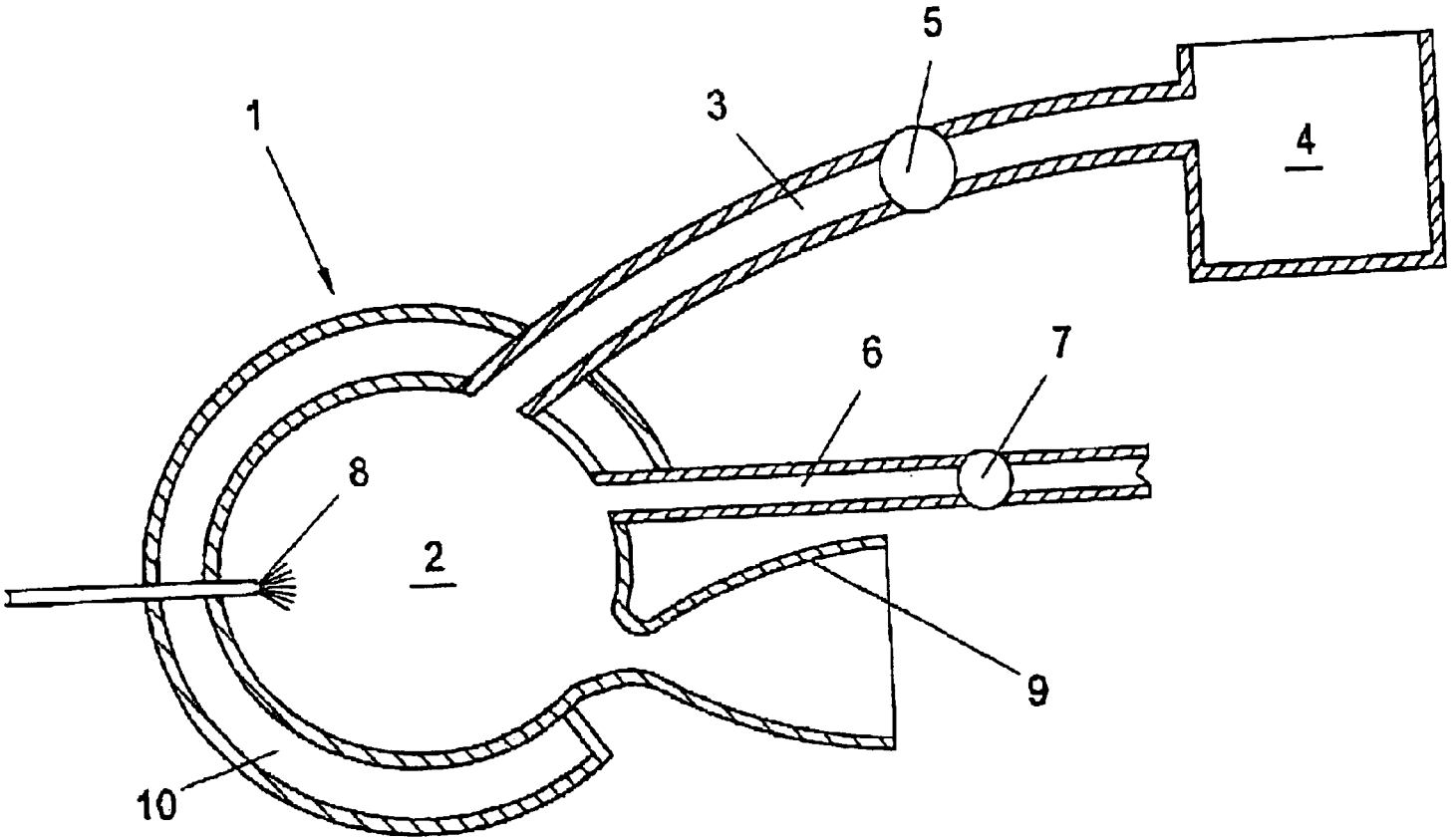
FIG. 1 shows a section of a first embodiment of the arrangement according to the invention.

The arrangement shown in FIG. 1 consists of a combustion chamber 1 with a combustion space 2. Leading into this combustion space 2 is a feed line 3 through which small-grained oilseeds are fed individually in succession from a reservoir 4 into the combustion space 2 through a controllable proportioning device 5, and a combustion air supply line 6 with a controllable blower 7. It must be ensured that after initial ignition has occurred, the pressure does not drop in combustion space 2 either through feed line 3 or through combustion air supply line 6. For that purpose, lines 3 and 6 may be provided with separate devices for maintaining the pressure in combustion space 2. However, it is advantageous to design the controllable proportioning device 5 and the controllable blower 7 in such a way that these devices also ensure that pressure is maintained in combustion space 2.

Combustion space 2 also contains a disconnectible preheating device 8 in the form of an oil burner.

When the arrangement according to the invention is started up, combustion space 2 is first of all preheated to a temperature of c. 1000° C. by means of the preheating device 8, after which a predetermined amount of seeds is fed to combustion space 2 through feed line 3, and these seeds ignite due to the high temperature in combustion space 2. Subsequently, additional individual seeds, whose number can be controlled by proportioning device 5, are fed in. At the same time, an amount of combustion air required for the complete combustion of the seeds is delivered through combustion air supply line 6 and the controllable blower 7. The unreduced seeds fed in succession are ignited explosively by the already burning seeds, resulting in a chain reaction which ensures the complete combustion without residue, after which the preheating device 8 can be disconnected.

The resulting flame exits from flame exit opening 9 and can then be utilized for heating purposes. Here, too, it must be ensured that no pressure drop results in the combustion space through this flame exit opening 9. In the embodiment shown as an example, this is accomplished because the flame exit opening is designed as a Venturi nozzle. The drawing shows only a one-stage Venturi nozzle, but in some cases it would be an advantage to provide a multi-stage Venturi nozzle with afterburner devices between the individual stages, which is not only certain to prevent a pressure drop in combustion space 2, but also ensures that the energy inherent in the oilseeds is completely utilized.

Instead of designing the flame exit opening as a Venturi nozzle, it can also be designed as a labyrinth.

The overheating of combustion chamber 1 is prevented by surrounding combustion space 2 with a cooling jacket 10.

Figure 2:
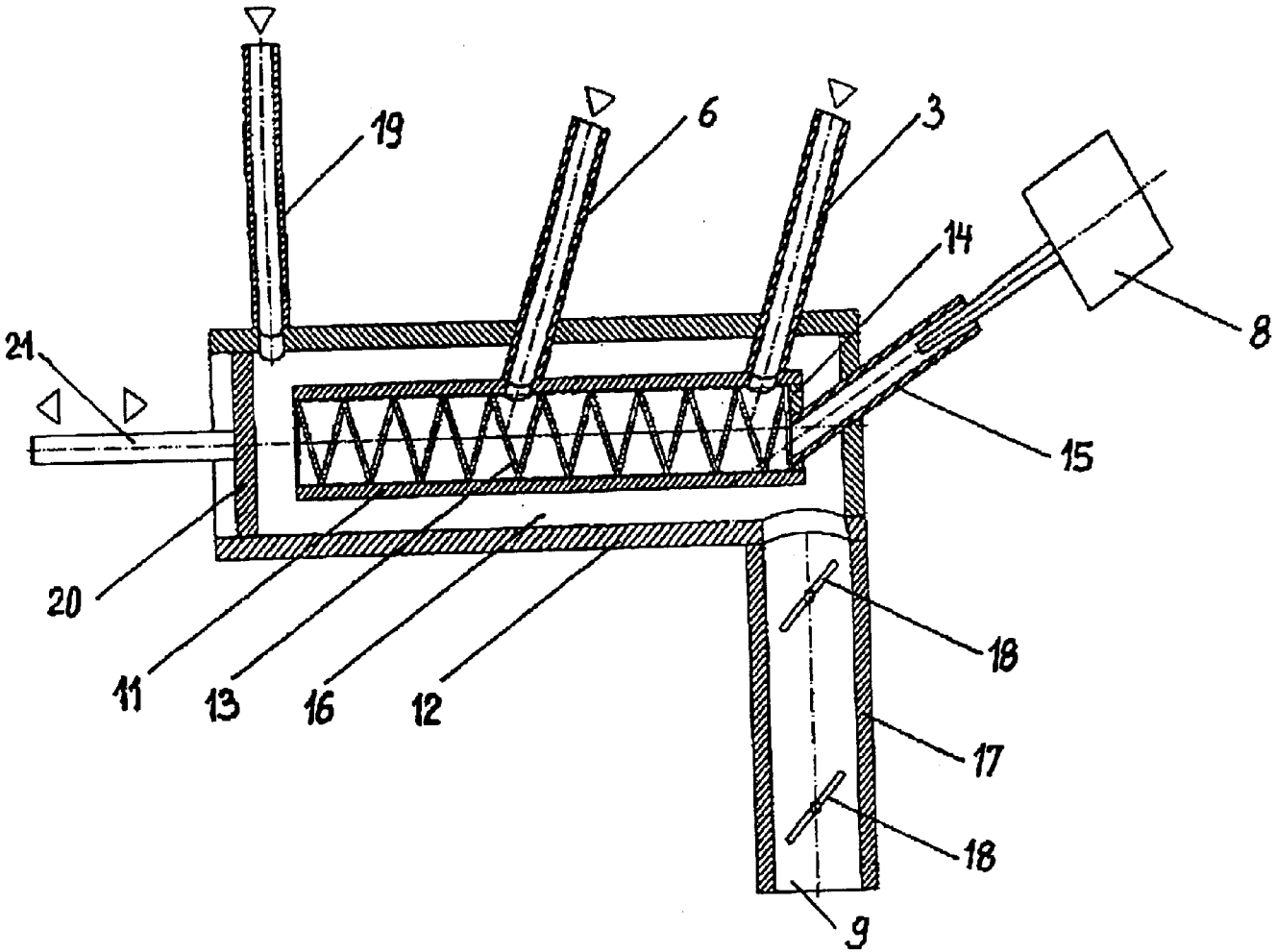
FIG. 2 shows another embodiment of the arrangement according to the invention.

In the embodiment of the arrangement according to the invention shown in FIG. 2, combustion space 2 consists of an interior tube 11 and an exterior casing 12 which surrounds the interior tube 11 with clearance and is also designed as a tube that extends coaxially to interior tube 11. A feed line 3, through which the small-grained oilseeds are fed from a storage container (not shown) to interior tube 1, leads tangentially into the interior tube. It is practical if the air that is used as the conveyance medium also forms part of the combustion air.

Also leading tangentially into interior tube 11 is a combustion air supply line 6 through which the primary air needed for the combustion of the seeds in the interior tube is delivered. The interior wall of interior tube I 1 is provided with a spiral recess 13 which forces the fed-in seeds to perform a spiral movement, thus prolonging their retention time in the interior tube.

One end of the interior tube is closed by a wall 14, in which a pipe end 15 is provided into which a preheating device 8 extends which may, for example, consist of a gas burner. The opposite end of interior tube 11 is open, allowing the interior tube to communicate with space 16 surrounded by exterior casing 12. Leading into this space 16 is pipe end 17 which forms flame exit opening 9 and which is provided with throttles 18. Furthermore, in the area of the open end of interior tube 12, space 16 is connected to another air supply line 19 which delivers secondary air.

One wall of exterior casing 12 is formed as a movable plate 20. It is moved via a rod 21 by means of an electrical actuator (not shown). By changing the position of plate 20, the volume of space 16 and thus of the combustion chamber can be varied.

Interior tube 11 and exterior casing 12 as well as plate 20 consist of fire resistant, in particular ceramic, material that is able to withstand temperatures up to 1600° C. which occur during the combustion of the seeds.

When the arrangement according to the invention, shown in FIG. 2, is started up, interior tube 11 is first of all preheated with preheating device 8 to a temperature required for the combustion of the seeds, for example to a temperature of 1000° C. Subsequently, a certain quantity of seeds is fed into the interior tube through feed line 3. The seeds move along spiral recess 13 and are ignited by the hot wall of the interior tube. During this, plate 20 is in a position in which the volume of space 16 is small, and the throttles 18 are open.

After initial ignition of the fed-in seeds has thus occurred, the preheating device can be disconnected. By changing the position of plate 20, the volume of space 16 is enlarged, and the direction of the throttles 18 is changed to closing position. The seeds successively fed through feed line 3 ignite due to the high temperature that now prevails in interior tube 11, causing a chain reaction, and these seeds burn explosively if the primary air is appropriately supplied through combustion air supply line 11. This prevents the temperature from dropping. The hot gases which occur at the open end of interior tube 11 are reversed and led through space 16 (which is surrounded by exterior casing 12 and in which, thanks to the supply of secondary air through air supply line 19, afterburning takes place) into pipe end 17, whereby the resulting flame exits from the flame exit opening 9. By appropriately controlling throttles 18, the required pressure is maintained in the combustion space. Due to the fact that a section of oilseed feed line 3 and a section of combustion air supply line 6 pass through space 16 in which a high temperature prevails, the seeds as well as the combustion air are preheated before entering interior tube 11, which means that combustion in interior tube 11 is promoted.

What is claimed is:

1. Method for producing thermal energy from small-grained oilseeds wherein a combustion space of a combustion chamber is first preheated to a temperature between 500° C. and 1250° C., and unreduced seeds as well as combustion air are fed into the combustion space in controlled amounts, thereafter preheating is discontinued, and a pressure of at least 2 bar is maintained in the combustion space, whereby subsequently fed in seeds burn explosively, and a resulting flame exits through a flame exit opening.

2. Method according to claim 1 wherein the temperature in the combustion space is about 1000° C.

3. Method according to claim 1 including maintaining a pressure between 2 bar and 13 bar in the combustion space.

4. Method according to claim 1 including feeding the oilseeds individually and in succession into the combustion chamber.

5. Method according to claim 1 including forcing the oilseeds to perform a spiral movement in at least one section of the combustion space.

6. Method according to claim 1 including varying a volume of the combustion space.

7. Arrangement for producing thermal energy from small-grained oilseeds in a continuous process comprising a combustion chamber with a combustion space in which a disconnectible preheating device is provided, and into which lead a feed line for feeding in the oilseeds and at least one combustion air supply line, and which is provided with a flame exit opening, and devices in the feed line, the at least one combustion air supply line and the flame exit opening for maintaining a pressure of at least 2 bar in the combustion space.

8. Arrangement according to claim 7 including a controllable proportioning device in the feed line for feeding in the oilseeds.

9. Arrangement according to claim 7 wherein the combustion space comprises an interior tube and an exterior casing surrounding said interior tube with clearance and communicating with said interior tube.

10. Arrangement according to claim 9 wherein the feed line leads into the interior tube in which the disconnectible preheating device arranged and the flame exit opening is provided in the exterior casing.

11. Arrangement according to claim 9 wherein the interior tube includes an interior wall with a spiral recess and wherein the feed line leads tangentially into the interior tube.

12. Arrangement according to claim 9 wherein the exterior casing includes an adjustable end wall extending across an axis of the interior tube.

13. Arrangement according to claim 12 wherein a wall of the exterior casing comprises a plate that can be moved by means of an electrical actuator.

14. Arrangement according to claim 7 including at least one combustion air supply line leading tangentially into the interior tube.

15. Arrangement according to claim 14 including another combustion air supply line for the delivery of secondary air leading into a space surrounded by the exterior casing.

16. Arrangement according to claim 7 including a controllable blower coupled to the at least one combustion air supply line.

17. Arrangement according to claim 8 wherein the flame exit opening comprises a Venturi nozzle.

18. Arrangement according to claim 17 wherein the flame exit opening comprises a multi-stage Venturi nozzle and an afterburner device provided between different stages of the Venturi nozzle.

19. Arrangement according to claim 7 including at least one throttle in the flame exit opening configured as a pipe end.

20. Arrangement according to claim 7 wherein the flame exit opening is configured as a labyrinth.

21. Arrangement according to claim 7 wherein the combustion chamber and the combustion space are defined by an interior tube and an exterior casing surrounding the tube and made of a fire resistant ceramic material.

22. Arrangement according to claim 7 including a cooling jacket surrounding the combustion space.

23. Method for producing thermal energy from small-grained oilseeds wherein a combustion space of a combustion chamber is first preheated and unreduced seeds as well as combustion air are fed into the combustion space in controlled amounts, thereafter preheating is discontinued and a pressure of at least 2 bar is maintained in the combustion space, whereby subsequently fed in seeds bum explosively, and a resulting flame exits through a flame exit opening, and wherein in at least one section of the combustion space the fed-in oilseeds are forced to perform a spiral movement.

24. Method for producing thermal energy from small-grained oilseeds wherein a combustion space of a combustion chamber is first preheated and unreduced seeds as well as combustion air are fed into the combustion space in controlled amounts, thereafter preheating is discontinued and a pressure of at least 2 bar is maintained in the combustion space, whereby subsequently fed in seeds burn explosively, and a resulting flame exits through a flame exit opening, and wherein a volume of the combustion space is variable.

25. Arrangement for producing thermal energy from small-grained oilseeds comprising a combustion chamber with a combustion space in which a disconnectible preheating device is provided, and into which lead a feed line for feeding in the oilseeds and at least one combustion air supply line, and which is provided with a flame exit opening, devices for maintaining a pressure in the combustion space, the combustion space comprising an interior tube, and an exterior casing surrounding the interior tube with clearance and communicating with the interior tube.

26. Arrangement for producing thermal energy from small-grained oilseeds comprising a combustion chamber with a combustion space in which a disconnectible preheating device is provided, and into which lead a feed line for feeding in the oilseeds and at least one combustion air supply line, and which is provided with a flame exit opening, devices for maintaining a pressure in the combustion space, the combustion space comprising an interior tube and an exterior casing surrounding and communicating with the interior tube, and at least one combustion air supply line leading into the interior tube.

27. Arrangement for producing thermal energy from small-grained oilseeds comprising a combustion chamber with a combustion space in which a disconnectible preheating device is provided, and into which lead a feed line for feeding in the oilseeds and at least one combustion air supply line, and which is provided with a flame exit opening, devices for maintaining a pressure in the combustion space, and at least one throttle in the flame exit opening which is designed as a pipe end.

* * * * *